US009205976B2

(12) United States Patent
Clark

(10) Patent No.: US 9,205,976 B2
(45) Date of Patent: Dec. 8, 2015

(54) DEVICE AND METHOD FOR COLLECTING LEAF AND YARD DEBRIS

(71) Applicant: Wanda Harper Clark, Greenwood, MS (US)

(72) Inventor: Wanda Harper Clark, Greenwood, MS (US)

( * ) Notice: Subject to any disclaimer, the term of this patent is extended or adjusted under 35 U.S.C. 154(b) by 0 days.

(21) Appl. No.: 13/900,259

(22) Filed: May 22, 2013

(65) Prior Publication Data

US 2013/0320159 A1 Dec. 5, 2013

Related U.S. Application Data

(60) Provisional application No. 61/653,130, filed on May 30, 2012.

(51) Int. Cl.

| | |
|---|---|
| ***B66F 19/00*** | (2006.01) |
| ***B65F 1/00*** | (2006.01) |
| ***B65F 1/10*** | (2006.01) |
| ***B65F 1/14*** | (2006.01) |

(52) U.S. Cl.

CPC . *B65F 1/002* (2013.01); *B65F 1/10* (2013.01); *B65F 1/1415* (2013.01); *B65F 2240/138* (2013.01)

(58) Field of Classification Search

CPC B65B 67/1238; B65B 67/12; B65B 67/1227; B65B 67/04; B65B 67/1205; B25B 33/00; A01B 1/02; A01F 2025/145; B65F 2240/138; B65F 1/002; B65F 1/10; B65F 1/1415

USPC ..... 294/214, 219, 55; 248/95, 97, 99, 248/100–101; 141/108, 114, 390, 391

See application file for complete search history.

(56) References Cited

U.S. PATENT DOCUMENTS

| | | | | |
|---|---|---|---|---|
| 3,936,087 | A * | 2/1976 | Alexander | 248/99 |
| 4,530,533 | A * | 7/1985 | Dieter | 294/214 |
| 5,129,609 | A * | 7/1992 | Tobin | 248/97 |
| 5,836,696 | A * | 11/1998 | Schnell | 383/120 |
| 6,007,030 | A | 12/1999 | Judge | |
| 6,708,742 | B2 * | 3/2004 | Weathers et al. | 141/391 |
| 7,219,705 | B2 * | 5/2007 | Wallek | 141/340 |
| 7,302,978 | B1 | 12/2007 | Kolarik | |
| 2004/0195468 | A1 | 10/2004 | Singleton | |
| 2006/0144467 | A1 | 7/2006 | Butzer et al. | |
| 2008/0023595 | A1 | 1/2008 | Armaly, Jr. | |
| 2011/0226914 | A1 * | 9/2011 | Fleming | 248/99 |
| 2012/0012228 | A1 | 1/2012 | Karabas et al. | |

* cited by examiner

*Primary Examiner* — Stephen Vu

(74) *Attorney, Agent, or Firm* — Sutherland Asbill & Brennan LLP

(57) ABSTRACT

Device and method for collecting leaf and yard debris, including an apparatus comprising a flexible thermoplastic sheet having a top portion and a bottom portion that are connected or partially connected. Embodiments include a two-piece design with separate top and bottom portions that are reversibly, semi-permanently, or permanently connected, so the two portions can be folded for storage. Other embodiments include a one-piece design having left side and right side cut-out areas and horizontal slits. In each embodiment, the top portion can be rolled into a cylindrical shape independently of the bottom portion, which maintains its planar configuration. Once rolled, the cylindrical top portion can be inserted into the opening of a lawn bag, and the material tension expands the cylinder to snugly fit the bag opening, thereby aiding in collecting leaf and yard debris.

21 Claims, 4 Drawing Sheets

DEVICE AND METHOD FOR COLLECTING LEAF AND YARD DEBRIS

CROSS REFERENCE TO RELATED APPLICATIONS

This application claims the benefit of U.S. Provisional Patent Application No. 61/653,130, filed May 30, 2012, which is incorporated herein by reference in its entirety.

FIELD OF THE INVENTION

This disclosure is related to devices and methods for collecting and aiding the collection of leaf and yard debris.

BACKGROUND OF THE INVENTION

Each autumn, many homeowners are faced with the annual task of collecting and disposing of leaves that have fallen from their trees and now blanket their lawns. Many communities now require that such leaves or lawn debris be placed into "lawn and leaf bags" before city or county services will collect them for disposal. Lawn and leaf bags essentially constitute large paper or plastic sacks, which are readily available from hardware or home improvement stores and which are relatively inexpensive.

Using lawn bags can be difficult and frustrating because their non-rigid structure makes them unwieldy and awkward to handle. Maintaining the collapsible bag in its "open" position and accessible for receiving leaves is a constant struggle, regardless of whether the bag is standing upright or placed on its side on the ground. In either arrangement, one is tasked with both holding the mouth of the bag open with one hand, while manipulating the rake with the other, a tiring and inefficient proposition at best.

Because raking and collecting leaves into lawn bags is a physically demanding chore, and manipulating the lawn bag itself makes this effort even more difficult, what is needed is a simple means of handling lawn bags that will ease the difficulty of use and make the entire effort less challenging. In particular, what is needed is a way to address the problem of its non-rigid structure and propensity of the bag opening to simply collapse during use.

SUMMARY OF THE INVENTION

According to one aspect of this disclosure, there is provided an apparatus for use with a lawn and leaf bag, or simply "waste bag", having a collapsed and substantially planar configuration and an expanded and substantially cylindrical configuration. In both its expanded and its collapsed configurations, only a first top portion of the apparatus as a whole is expandable and collapsible between these configurations, while a second bottom portion of the apparatus maintains a substantially flat or planar configuration in both the so-called expanded and collapsed configurations. In its expanded cylindrical configuration, at least part of the cylindrical first portion can be inserted into the opening of a waste bag. The apparatus is flexibly biased toward its collapsed configuration, due to the tension or memory of the polymeric material it is made of. Therefore, after placement into the waste bag opening, the expanded cylindrical first portion is allowed to unfold to the extent possible and increase the diameter of the cylinder-shaped first portion. By allowing the flexible bias of the cylindrical portion to expand the diameter of the cylinder, the first portion of the device exerts pressure on the inside of the waste bag, thereby retaining the waste bag in the open configuration.

The apparatus further includes a second portion that maintains a substantially flat or planar configuration in both the collapsed and the expanded configurations of the apparatus. Reference to the collapsed and the expanded configurations of the apparatus are used interchangeably with reference to the collapsed and the expanded configurations of the first portion of the apparatus. The second portion is useful in, for example, providing a convenient platform to ease sweeping of the leaves and yard debris into the open mouth of the waste bag and to secure the entire apparatus and bag to the ground, if desired. In particular, the flat surface of the second portion can be especially useful for sweeping smaller lawn debris such as grass clippings, pine needles, and the like into the waste bag opening.

In one aspect, the first portion and the second portion of the apparatus are separate pieces or sections of flexible material that are connected or joined to form the assembled apparatus. For example, the first portion (or section) and the second portion (or section) of the apparatus can be separate pieces of flexible polymeric material, which can be joined or connected at or near the center of a connecting edge. This two-section embodiment allows the device to be folded or the first and second sections to be disconnected for easier carrying and storage. In the connected or unfolded configuration, the first portion and the second portions of the apparatus are contiguous. In some embodiments, the first and second sections can use the same or similar type of flexible material such as a polymeric material having the desired flexibility or weight. In other embodiments, the first and second sections of the apparatus can be made of different types or thicknesses of polymeric materials in order to independently adjust the desired properties of the top and bottom sections of the apparatus, such as flexibility, weight, color, transparency, and the like.

Without the use of some device such as the one disclosed herein, leaves and debris must almost always be picked up or handled in some fashion to place them in a bag. One feature of the present device is that it removes the need for the user to touch the debris.

There have been several other attempts to address the problems associated with using lawn bags that employ some type of device that inserts completely within the lawn bag or partially into the opening of the bag. Some of these devices have a square or rectangular cross sections which, while helpful in maintaining the bag in its open position, have corners that are prone to tear the bag upon insertion or extraction. These corners make removing the device rather difficult once the bag is filled with leaves. Moreover, such a device is suitable for only a single size of waste bag and requires assembly and disassembly each time it is employed. Funnel-type devices have been disclosed that also appear useful, but such funnels include a neck portion that is situated inside the bag opening and which creates a bottleneck when attempting to fill the bag. Other types of devices have complicated perforations, tabs, slots, elaborate cut-outs, and generally complex structural elements that make them expensive to manufacture and often not sufficiently durable to last more than a single season. These devices also require difficult assembly and disassembly each time they are used. Other elaborate designs have been proposed that require expensive materials and/or manufacturing methods that increase the costs of the device.

The present disclosure provides a simple device and method of using the device for collecting and aiding the collection of leaf and yard debris. Reference is made to the accompanying figures, which are incorporated in and constitute a part of this specification, and which illustrate several aspects described below.

DETAILED DESCRIPTION OF THE INVENTION

The subject matter of this disclosure may be understood more readily by reference to the following detailed description of specific aspects thereof. It is understood that the terminology used herein is for the purpose of describing particular aspects of the disclosed subject matter and is not intended to be limiting.

Generally and according to various aspects, this disclosure provides a relatively thin, flexible sheet made from a thermoplastic polymer such as polyethylene, polypropylene, or polyethylene terephthalate, that includes a top portion and a bottom portion that are partially connected. The bottom portion generally has two triangular shapes cut out of the opposing (left and right) sides and slits in the sheet material that can extend horizontally from opposing sides and/or extend from the cut-out area toward the center line of the sheet. The bottom portion is designed to retain its planar configuration which becomes the "base" of the cylinder once the top portion above the slits is formed or folded into a cylindrical configuration. The cut-out areas and the slits enable the top half of the sheet to be formed into a cylinder shape. The cylinder can then be inserted into the opening of a lawn bag, and the tension or memory in the plastic sheet causes the cylinder to expand to fit the specific size of the bag opening. If desired, strips of self-adhesive hook-and-loop fastener or other fastener types on opposite sides and ends of the top portion used to form the cylinder can be used to keep the material from uncurling to slip out of the bag opening. In some embodiments, small silicone dots can be added around the outer edge of the back side of the sheet that contacts the inside of the waste bag to help hold the bag in place. On the opposite end of the cylinder, the remaining part of the sheet lies flat. If desired, small holes can be included on the outer edge of the flat side that are intended for ground stakes, such as plastic or metal stakes, to keep the sheet from moving during use until desired.

Various embodiments are disclosed, including a single-piece construction and a two- or multi-piece construction. The description of the single-piece construction in its collapsed or planar configuration is generally applicable to the two- or multi-piece construction in its collapsed or planar configuration, in which the individual sections are connected. Thus, descriptions such as angles, cut-outs, lengths and the like used to describe the single-piece construction generally can be applied to the assembled two-piece construction.

Figure 1:
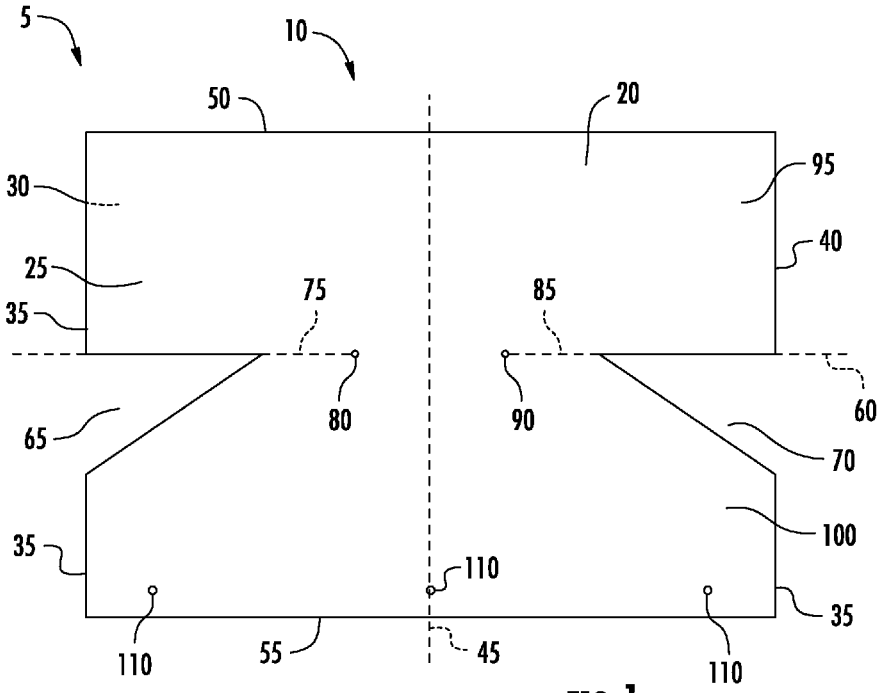
FIG. 1 is a view of the front side of an embodiment of the apparatus of this disclosure in its collapsed or planar configuration, illustrating various features of including the cut lines, cut-outs, and optional holes useful in staking and storing the device.

Referring now to FIG. 1, among other things, this disclosure provides an apparatus 5 for use with a waste bag, the apparatus having a collapsed configuration 10 and an expanded configuration 15 and comprising in its collapsed configuration a flexible rectangular sheet 20, the sheet comprising:

a) a front side 25 and a back side 30;

b) when viewed from the front side, a left edge 35, a right edge 40, a vertical axis 45 parallel to and equidistant from the left and right edges, a top edge 50, a bottom edge 55, and a horizontal axis 60 parallel to and equidistant from the top and bottom edges;

c) a first cut-out 65, one edge of which is defined by a portion of the left edge 35, and a second cut-out 70, one edge of which is defined by a portion of the right edge 40;

d) a first slit 75 extending from the first cut-out 65 toward but not intersecting the vertical axis 45 and ending at a first terminus 80 and a second slit 85 extending from the second cut-out 70 toward but not intersecting the vertical axis 45 and ending at a second terminus 90;

wherein the first and second slits and the first and second termini define a top portion 95 extending therefrom (that is, from first and second slits and the first and second termini) to the top edge 50 and a bottom portion 100 extending therefrom (that is, from first and second slits and the first and second termini) to the bottom edge 55; and wherein the apparatus 5 is flexibly biased toward the collapsed configuration 10. Generally, the first cut-out 65 and the second cut-out 70 can be triangular in shape, which allows the full functional utility of the cut-out to be achieved and provides for convenient and low cost fabrication of the apparatus. If the first slit 75 and the second slit 85 extend at right angles from the left edge 35 and right edge 40, respectively, then the first cut-out and the second cut-out are in the shape of right triangles. However, this is not a requirement of the apparatus.

In one aspect, as illustrated in the embodiment of FIG. 1, the first slit 75 and the second slit 85 can be linear, and they can extend at right angles from the left edge 35 and right edge 40, respectively. However neither of these features is a requirement for the apparatus to achieve its intended function. In this aspect, the first slit 75, the second slit 85, or both can be linear; alternatively, the first slit 75, the second slit 85, or both can be curved; alternatively, the first slit 75, the second slit 85, or both can comprise a combination of any desired number of linear sections, curved portions, or both, if desired. In another aspect, the first slit 75, the second slit 85, or both the first and the second slits can extend at an initial angle from the left edge 35 and right edge 40, respectively, of 90°; alternatively, about 90°; alternatively, about 85°; alternatively, about 80°; alternatively, about 75°; alternatively, about 70°; alternatively, about 65°; alternatively, about 60°; alternatively, about 55°; alternatively, about 50°. In particularly useful embodiments, the first slit 75 and the second slit 85 can be linear, and they can extend at right angles from the left edge 35 and right edge 40, respectively.

When the apparatus is viewed from the front side, the horizontal axis 60 is defined as the axial line extending from the left edge to the right edge of the apparatus, parallel to the top and bottom edges and midway therebetween. Similarly, the vertical axis 45 is defined as the axial line extending from the top edge to the bottom edge of the apparatus, parallel to the left and right edges and midway therebetween. The first slit 75 and the second slit 85 can be coincident with the horizontal axis, if desired, generally tracing a boundary between the top portion 95 and the bottom portion 100 of the apparatus. Depending on the desired size of the top portion of the apparatus, for example, to achieve a fit to a particular waste bag, the first slit 75 and the second slit 85 can be substantially parallel to the horizontal axis (±10° of parallel) and are within about 50% of the distance from the horizontal axis to the top edge or within about 50% of the distance from the horizontal axis to the bottom edge. In other embodiments, the first and second slits can be substantially parallel to the horizontal axis and within about 25% of the distance from the horizontal axis to the top edge or within about 25% of the distance from the horizontal axis to the bottom edge.

Figure 2:
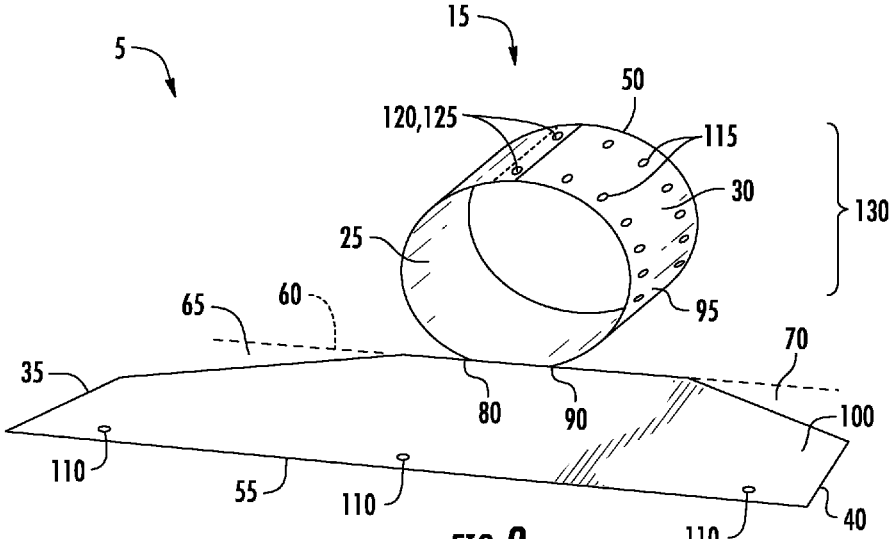
FIG. 2 is a perspective illustration of the general shape of an embodiment of the disclosed apparatus, showing the device in use in its expanded or cylindrical configuration.

In addition to the slits as described herein, the disclosed apparatus can include cut-out portions that are essentially removed from the overall rectangular shape of the apparatus. For example, and as illustrated in FIG. 1, the cut-outs are generally in the bottom portion of the apparatus and generally include one edge that is defined by at least a portion of the first and second slits. Preferably, one edge of each cut-out is defined by a portion of the first and second slits. Further, the first cut-out 65 and the second cut-out 70 are contained within 50% of the distance from the horizontal axis to the bottom edge, although this is not required. As illustrated in FIG. 1, the first cut-out 65 and the second cut-out 70 can be triangular in shape. As shown in FIG. 2, the cut-outs provide different functions, for example, providing for ease of folding or forming the top portion of the device into the expanded or cylindrical configuration, to allow for easy manipulation of the cylindrical top portion in and out of the waste bag with minimal interference from the bottom portion of the apparatus, and to assist the bottom portion in retaining its planar configuration even when the top portion is formed into a cylinder.

In one aspect, the first and second cut-outs can be triangular, and in another aspect, the first cut-out and the second cut-out are right triangles. If the first slit 75 and the second slit 85 extend at a 90° angle from the left edge 35 and right edge 40, respectively, the first cut-out and the second cut-out are right triangles because one edge of each cut-out is defined by a portion of the first and second slits.

In one aspect of describing the rectangular configuration, the length of the top and bottom edges of the apparatus generally can be greater than or equal to the length of the left and right edges of the apparatus. In some embodiments, the length of the top and bottom edges of the apparatus generally can be equal to or less than the length of the left and right edges of the apparatus. That is, when viewed from the front side, the length of the top edge 50 or the bottom edge 55 (corresponding to that distance along the horizontal axis 60) can be greater than, equal to, or less than the length of the left edge 35 and right edge 40 (corresponding to the distance along the vertical axis 45 between top edge 50 and bottom edge 55, so that the edge portion removed by the cut-outs in left edge 35 and right edge 40 is included in this distance), in the general rectangular configuration.

The particular configuration can be selected on the basis of the size of the particular waste bag expected to be used with the apparatus, the size of the planar first portion that is desired for a convenient platform for ease of raking or sweeping debris into the opening of the bag, and the like. Generally, embodiments of the apparatus include those having a ratio of the length of the horizontal axis 60 (between left edge 35 and right edge 40) to the length of the vertical axis 45 (between top edge 50 and bottom edge 55) from about 2:1 to about 1:1. Preferred ratios of the length of the horizontal axis 60 (between left edge 35 and right edge 40) to the length of the vertical axis 45 (between top edge 50 and bottom edge 55) can be from about 1.8:1 to 1.3:1; alternatively, from about 1.7:1 to about 1.4:1; and alternatively, from about 1.6:1 to about 1.5:1.

Figure 4:
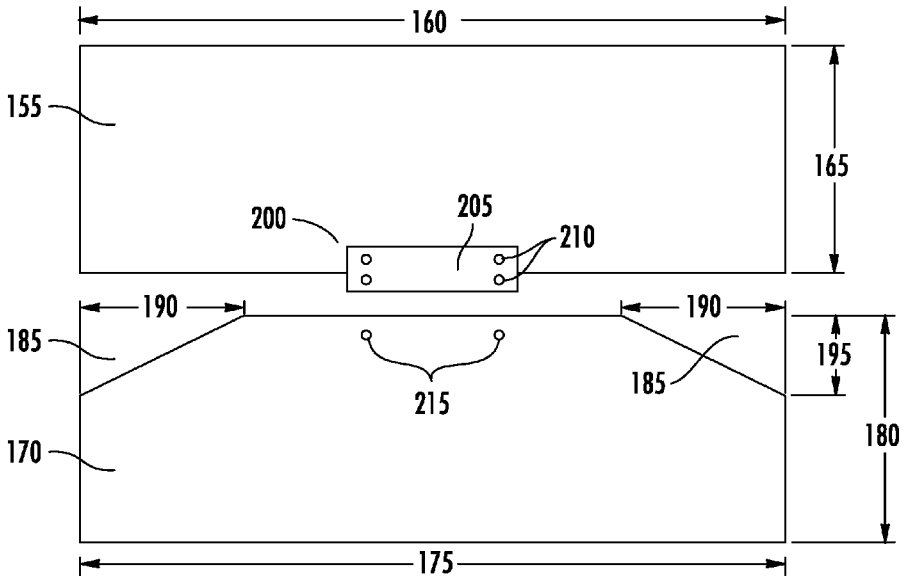
FIG. 4 is a view of the front side of another embodiment of the apparatus of this disclosure in its collapsed or planar configuration, illustrating the two-piece construction and connection means, showing the relative alignment of the top and bottom portions prior to their being connected for assembly. Also illustrated are means for connecting the center portion of the bottom edge of the first flexible sheet to the center portion of the top edge of the second flexible sheet for use of the apparatus, specifically adhesive fabric or tear-resistant fabric 205 and rivets 210. Rivets 210 such as snap rivets are illustrated an exemplary means for connecting the fabric strip 205 to both top and bottom sections. The rivets 210 extend through holes 215 in both top and bottom sections, although holes 215 are shown only in the bottom section because the rivets are shown connecting the fabric strip 205 to the top section in FIG. 4.
Figure 5A:
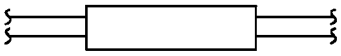
FIG. 5 illustrates additional means for connecting the center portion of the bottom edge of the first flexible sheet to the center portion of the top edge of the second flexible sheet for use, specifically: (A) adhesive tape or adhesive fabric; (B) hook ("H")-and-loop ("L") fasteners; (C) interlocking tabs and slots; (D) corresponding hooks and holes; and (E) corresponding hooks and loops.
Figure 5B:
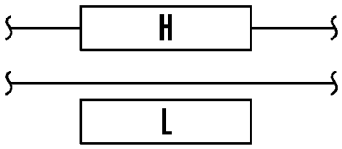
Figure 5C:
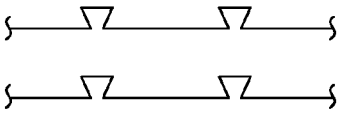
Figure 5D:
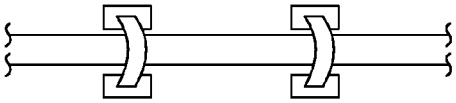
Figure 5E:
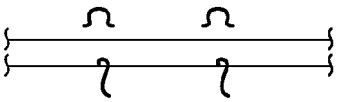
Figure 6A:
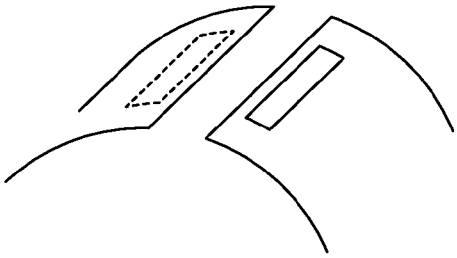
FIG. 6 illustrates embodiments in which the first flexible sheet further comprises at least one first fastener portion situated on the left edge, and at least one corresponding second fastener portion situated on the right edge. Illustrated in this figure are: (A) corresponding portions of hook-and-loop pieces; B) snap fasteners; and (C) hooks and holes.
Figure 6B:
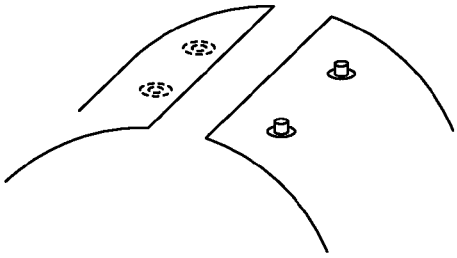
Figure 6C:
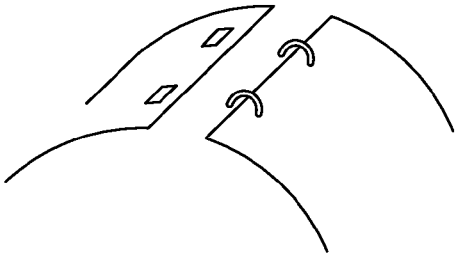

In the two-piece embodiments disclosed herein, one embodiment of which is illustrated in FIG. 4, these preferred ratios of the length of the horizontal axis to the length of the vertical axis are approximately the same, wherein the horizontal axis is obtained from the length of either the top or bottom sections, and the vertical is obtained from the total height of the top section plus the height of the bottom section. Thus, in FIG. 4, the horizontal axis can be taken from 160 or from 175, and the vertical axis is the combination of distances 165 and 180, when applying the preferred ratios.

The sheet itself can vary in size to accommodate any size of waste bag. For conventional 30-gallon yard bags, the sheet can be from about 48 inches to about 90 inches wide (from left edge to right edge) by about 30 inches to about 60 inches high (from top edge to bottom edge). Alternatively, the width of the sheet can be from about 55 inches to about 85 inches wide, from about 60 inches to about 80 inches wide, or from about 63 inches to about 73 inches wide, that is, from left edge to right edge. Also alternatively, the height of the sheet (from top edge to bottom edge) can be from about 35 inches to about 55 inches high, or from about 40 inches to about 50 inches high, that is, from top edge to bottom edge. For example, in one particular embodiment, the sheet is about 68 inches wide (from left edge to right edge) by about 44 inches high (from top edge to bottom edge), and this size works well for conventional 30-gallon yard bags.

FIG. 1 also illustrates an embodiment of the apparatus of this disclosure, that is, the bottom portion of the device can comprise one or more holes 110 along the bottom edge. These holes are useful for staking and securing the device to the ground when in use and/or for storing the device in its collapsed and planar configuration by hanging it vertically from hooks or pegs of some type, which correspond to the holes to secure it. If desired, one or more holes also can be included along the top edge (not shown in FIG. 1) for convenience in storing the device in its collapsed and planar configuration by hanging it by its top edge. Embodiments include a kit comprising the disclosed device, which can further include any number of ground stakes and/or hanging rack for securely storing the apparatus with the flexible sheet in its collapsed (planar) configuration.

According to one aspect, the flexible sheet 20 can comprises a thermoplastic or a thermoplastic elastomer. For example, the sheet can comprises a polyolefin, a polyester, a polyamide, a polyimide, a polylactide, copolymers thereof, or blends thereof. Particularly useful materials from which the sheet can be fabricated include, but are not limited to, polyethylene, polypropylene, polyethylene terephthalate, polyethylene isophthalate, a copolymer thereof, or a blend thereof. Because the apparatus is flexibly biased toward its collapsed configuration, due to the tension or memory of the polymeric material, the desired tension can be obtained by changes in the thickness of the material and in the selection of the polymer used to make the apparatus, as appreciated by one of ordinary skill in the art.

FIG. 2 is a perspective illustration of the general shape of an embodiment of the disclosed apparatus, showing the device in use in its "expanded" cylindrical configuration. Thus, force is required to form or fold the device into the cylindrical shape such that it can be inserted into a lawn or waste bag. When the pressure used to form the cylindrical shape is removed once the top portion is situated inside a waste bag, the tension or memory of the polymeric material expands the diameter of the cylindrical shape as the device attempts to unwind and return to its lower energy expanded configuration, thereby holding the bag in the open position with a cylindrical opening.

This disclosure also provides for a method of collecting debris, comprising:

a) providing an apparatus 5 according to this disclosure;

b) folding the top portion of the left edge and the top portion of the right edge toward each other to substantially form the top portion 95 of the apparatus into a cylinder having a flexible bias toward the collapsed (planar) configuration 10;

c) inserting at least a portion of the cylindrical top portion of the apparatus into a waste bag; and d) allowing the flexible bias of the cylindrical top portion 95, as illustrated in FIG. 2, to expand the diameter of the cylinder and exert pressure on the inside of the waste bag, thereby retaining the waste bag in the open configuration.

This method can further comprise staking the bottom portion of the apparatus to the ground, if desired, to impart additional stability to the apparatus and bag, and allow a hands-free use of the device. According to one aspect, substantially all the cylindrical top portion of the apparatus is inserted into the waste bag. Alternatively, the majority of the cylindrical top portion of the apparatus is inserted into the waste bag.

In a further aspect, the device can further comprise at least one first fastener piece 120 attached to the front side or the back side near the right edge of the top portion 95 and at least one corresponding second fastener piece 125 attached to the back side or the front side, respectively, near the left edge of the top portion 95. Generally, the first and second fastener pieces are situated to come into contact when the top portion is folded into its cylindrical configuration and the right edge of the top portion and the left edge of the top portion approach or slightly overlap. Each fastener piece typically is attached close to the right edge and left edge, for example, less than about 25%, less than about 20%, less than about 15%, less than about 10%, or less than about 5% of the distance from its respective edge to the vertical axis. In another aspect, the device can further comprise at least one first fastener piece attached on the front side of the top right edge and at least one corresponding second fastener piece attached to the back side of the top left edge; or at least one first fastener piece attached on the front side of the top left edge and at least one corresponding second fastener piece attached to the back side of the top right edge.

Examples of suitable first and second fastener pieces include, but are not limited to, hooks, snaps, or hook-and-loop pieces. It has been found that the first fastener and second fastener pieces work well when they are hook-and-loop pieces. There is also no particular limit on the upper or lower limit of the number of fastener pieces. It has been found that two or three pair of corresponding fastener pieces work well.

To assist the cylindrical top portion of the device in being secured to the waste bag, it is also possible to include silicone dots 115 on the back side 30 of the apparatus, which is the side that contacts the inside of the waste bag. While a single silicone dot, or silicone material of any shape, will assist in holding the device, the device works well with multiple dots 115 in place on the back side 30 of the top portion 95 of the apparatus. Any number of silicone patches or dots are suitable, and one of ordinary skill will understand that more dots are expected to hold the device and the waste bag more securely. The location of the silicone dots are not critical and can be adjusted as appreciated by one of ordinary skill. However, typically, the small silicone dots can be added around the outer edge to help hold the bag in place, as shown in FIG. 2 around outer edges of the back side 30 of the top portion 95. In one aspect, the silicone dots can be situated at less than about 25% of the distance from any edge of the top section of the device. This aspect of the apparatus is not limited to silicone, as any material or combination of materials having sufficient adhesion to reversibly hold the lawn or leaf bag securely in place while in use, yet allowing easy removal of the bag can be employed. It is also envisioned that this adhesive material for reversibly holding the leaf bag may itself be permanently attached to the back side 30 of the top portion 95 of the apparatus using a different and more permanent type adhesive compatible therewith, if desired.

As illustrated in FIG. 2, the apparatus in its expanded or cylindrical configuration is characterized by folding the top portion of the left edge extending from the first slit to the top edge, and the top portion of the right edge extending from the second slit to the top edge, toward each other to substantially form the top portion of the apparatus into a cylinder or a portion of a cylinder, while the bottom portion of the apparatus between the bottom edge and the first and second slits remains substantially planar. In its expanded configuration, the top portions of the left edge and the right edge can touch or overlap each other. Alternatively, the top portions of the left edge and the right edge are not required to touch or overlap each other.

When the top portions touch, overlap, or come into proximity, depending on the type of fasteners, the left edge and the right edge of the top portion can be fastened together if desired. This embodiment is particularly suitable when stiff materials are desired, and the tension and memory of the material is sufficiently strong to uncurl the device into a cone shape. This tendency can be mediated with use of fasteners, for example, on each end of the folded cylinder, to keep the top portion of the device in its most effective cylindrical shape. For example, hooks, snaps, or hook-and-loop fastener pieces, or any other suitable fasteners can be employed. In one aspect, with the particular placement of fasteners such as hook-and-loop fastener pieces, the top portion of the apparatus can be rolled into a cylinder of suitable diameter for easy placement within a waste bag, wherein the respective hook-and-loop fastener pieces have been coiled or rolled past each other, then the apparatus can be allowed to uncoil to the point the hook-and-loop fasteners contact their respective partner pieces, and attach to each other to prevent further uncoiling. In this manner, the top portion of the apparatus can be held at the desired diameter, with the desired amount of tension on the waste bag, and prevented from further uncoiling. Once the size of the cylinder has been expanded to optimally fit the size of the bag opening, using the fasteners to keep this size speeds up the changing out of bags when they become full.

When using fastener pieces for the apparatus, there is further provided a method of collecting debris, the method comprising:

a) providing an apparatus that comprises at least one first fastener piece 120 attached to the front side or the back side near the right edge of the top portion 95 and at least one corresponding second fastener piece 125 attached to the back side or the front side, respectively, near the left edge of the top portion 95;

b) folding the top portion of the left edge 35 and the top portion of the right edge 40 toward each other to substantially form the top portion of the apparatus into a cylinder having a flexible bias toward the collapsed (planar) configuration;

c) inserting at least a portion of the cylindrical top portion 130 of the apparatus into a waste bag;

d) fastening the at least one first fastener piece to the at least one corresponding second fastener piece to maintain the cylindrical top portion 130 in the cylindrical configuration; and e) allowing the at least one silicone dot on the back side of the top portion to contact the inside of the waste bag, thereby reducing the propensity of the waste bag to slip from the cylindrical top portion.

According to another aspect and depending on the desired size of the cylindrical top portion and the tension that is desired for holding the apparatus to a waste bag, steps c) and d) can be reversed, such that the at least one first fastener piece can be fastened to the at least one corresponding second fastener piece to maintain the cylindrical top portion in the cylindrical configuration, and then at least a portion of the cylindrical top portion can be inserted into a waste bag.

Figure 3:
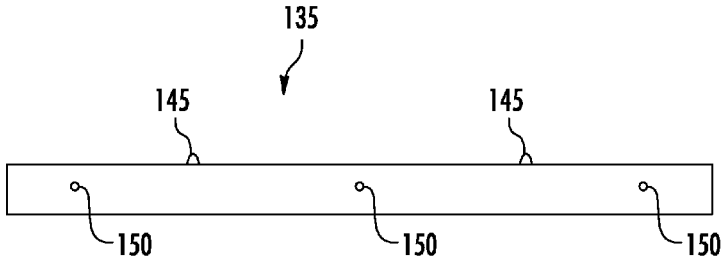
FIG. 3 is a drawing of an embodiment of one aspect of the apparatus of this disclosure, illustrating a hanging device by which the disclosed apparatus can be stored by hanging in its collapsed configuration.

According to embodiments of the apparatus as those shown in FIG. 1 and FIG. 2, the bottom portion of the device can comprise one or more holes along the bottom edge. These holes are useful for staking and securing the device to the ground when in use and/or for storing the device in its collapsed and planar configuration by hanging it vertically from hooks or pegs of some type, which can be inserted into the holes to secure it. A wall-mounted rack with pegs is suggested as an accessory for storing the sheet on a garage or storage room wall, as illustrated in FIG. 3. As illustrated in the FIG. 3 embodiment, the rack 135 can be a solid piece or telescoping rod with the pegs 150 that correspond to the placement of the holes 110 on the bottom edge of the sheet, and can include a means for securing the rack to the wall or other secure location. For example, FIG. 3 illustrates that the rack can be hung on the wall by hooks or loops 145 that are secured to the rack and sized to hang over nails or screws. Once the rack is mounted, the sheet can be hung on the rack by placing the holes 110 over the corresponding pegs. Optionally, holes for hanging the apparatus can be included along the top edge or any other edge (not shown in FIG. 1) for convenience in storing the device in its planar configuration by hanging it by that end. The hanging board and/or ground stakes can be included with the apparatus in the form of a kit that can be packaged and sold together for marketing purposes.

FIG. 4 illustrates another aspect of this disclosure by presenting a view of the front side of another embodiment of the apparatus in its collapsed or planar configuration, namely, a two-piece construction embodiment. FIG. 4 further illustrates the relative alignment of the top and bottom portions prior to their being connected or assembled into the ready-to-use apparatus. Generally, the one-piece construction as illustrated by the FIG. 1 embodiment can be divided into two or more sections or pieces for ease of storage and transport, and assembled or connected prior to their use using any connection means suitable to keep the pieces stably but reversibly attached, such that the assembled apparatus is stable and securely fastened during use, but can be disassembled easily for storage.

FIG. 4 illustrates an embodiment in which the two pieces or sections correspond to the top portion 95 and bottom portion 100 of FIG. 2, that is, two pieces created by theoretically cutting the FIG. 1 single-piece embodiment along horizontal axis 60. Any number of other two-piece or more than two-piece embodiments are possible, for example, one in which the two pieces are created by theoretically cutting the FIG. 1 single-piece embodiment along the vertical axis 45. Other embodiments can be envisioned, for example, in which the apparatus includes three sections that can be connected to provide the assembled device.

Generally any method can be used to connect the pieces together for use. Examples of connection means include, but are not limited to: an adhesive tape; adhesive fabric strips; hook-and-loop fasteners in which the two pieces overlap slightly; pieces cut to interlock using tabs and slots; one piece with a row of integral hooks and the other piece with a row of corresponding holes or loops; integral track and guide features; various rivets such as snap rivets or pop-in rivets; push-in fasteners; and any other method as understood by one of ordinary skill in the art. In one aspect, the pieces can be semi-permanently connected, for example, using strips of heavy duty adhesive tape or fabric, such that the two or more portions can be easily unfolded for use, and refolded or collapsed for storage. In this aspect, the adhesive tape or fabric is expected to remain in place permanently or semi-permanently for both use and storage, allowing the top and bottom portions to be flexibly connected and to fold and unfold easily without the need for removing and reattaching the adhesive tape or fabric.

Other semi-permanent connection means can include, for example, snap rivets or similar connectors used with a fabric that resists tearing, such as rip-stop fabric like nylon or Cordura®. As illustrated in FIG. 4, a strip of fabric can be connected to both top and bottom pieces (shown connected only to the top section in FIG. 4) using a snap rivet, pop rivet, and the like. In this configuration, the strip of fabric allows the top and bottom sections to readily fold so that the apparatus can be stored and deployed easily. That is, the fabric and rivet attachments can remain in place permanently or semi-permanently, allowing the top and bottom portions to be flexibly connected and to fold and unfold easily without the need for detaching or reattaching the fabric and rivet connection means.

Referring now to FIG. 4, there is provided an apparatus for use with a waste bag, the FIG. 4 apparatus also having a collapsed configuration and an expanded configuration and shown in its planar collapsed configuration as comprising two sections or pieces, a separate top section 155 and a separate bottom section 170. Top section 155, when viewed from the front side as shown, includes a top section length (or width) 160 and a top section height (or depth) 165, similar to the top portion of the FIG. 1 embodiment. Similarly, the FIG. 4 embodiment is also characterized by left and right edges of the top section having height 165, a vertical axis parallel to and equidistant from the left and right edges, top and bottom edges having length 160, and a horizontal axis parallel to and equidistant from the top and bottom edges. Similarly, bottom section 170, when viewed from the front side as shown, includes a bottom section length (or width) 175 and a bottom section height (or depth) 180, similar to the bottom portion of the FIG. 1 embodiment. The FIG. 4 embodiment is also characterized by left and right edges of the bottom section having height 180, a vertical axis parallel to and equidistant from the left and right edges, top and bottom edges of the bottom section having length 175, and a horizontal axis parallel to and equidistant from the top and bottom edges.

Also as illustrated in FIG. 4, bottom section 170 can include cut-outs 185. One edge of the cut-outs is defined by a portion of the top edge of the bottom section, shown as the cut-out length 190. Another edge of the cut-outs is defined by a portion of the left edge or right edge of the bottom section, shown as the cut-out height 195. In the FIG. 4 illustration, the first and second cut-outs are mirror images of each other, and they generally, though not necessarily, are mirror images. As a result, the connection means 200 generally extends part, most, or substantially all of the length of the portion of the top edge of the bottom section 170 that is not cut out. Connection means 200 is shown attached to the top section only in FIG. 4, and is used to attach to a corresponding portion of the bottom edge of the top portion 155. Generally, the cut-outs 185 can be triangular in shape, as illustrated in FIG. 4; however, this is not a requirement of the apparatus. Example 1 provides some measurement values of the top and bottom portions and the cut-outs that are an exemplary embodiment.

Various modifications of the design are possible for the disclosed apparatus; for example, the cut-outs themselves can be optional. In this embodiment, there is provided an apparatus 5 for use with a waste bag, the apparatus having an expanded configuration 10 and a collapsed configuration and comprising in its expanded configuration a flexible rectangular sheet 20, the sheet 20 comprising:

a) a front side 25 and a back side 30;

b) when viewed from the front side, a left edge 35, a right edge 40, a vertical axis 45 parallel to and equidistant from the left and right edges, a top edge 50, a bottom edge 55, and a horizontal axis 60 parallel to and equidistant from the top and bottom edges;

c) a first slit 75 extending from the left edge 35 toward but not intersecting the vertical axis 45 and ending at a first terminus 80;

d) a second slit 85 extending from the right edge 40 toward but not intersecting the vertical axis 45 and ending at a second terminus 90;

wherein the first and second slits and the first and second termini define a top portion 95 extending therefrom to the top edge 50 and a bottom portion 100 extending therefrom to the bottom edge 55; and wherein the apparatus 5 is flexibly biased toward the expanded configuration 10.

In another aspect and if so desired, the apparatus or device 5 can further comprise:

e) a first cut-out 65, one edge of which is defined by at least a portion of the left edge 35 and one edge of which is defined by at least a portion of the first slit 75; and f) a second cut-out 70, one edge of which is defined by at least a portion of the right edge 40 and one edge of which is defined by at least a portion of the second slit 85.

Several other design modifications are possible for the disclosed apparatus; for example, the overall geometry is not required to be a rectangle because the four corners are not required to subtend 90° angles. Additionally, opposite edges are not required to be parallel; for example in one embodiment, the top and bottom edges are parallel, but the left and right edges are both angled slightly outward from the top to bottom of the apparatus, such that the top edge is shorter than the bottom edge. It will be apparent to those skilled in the art that various other modifications and variations can be made within the context of the present disclosure without departing from the scope or spirit of the invention. Other embodiments of the invention will be apparent to those skilled in the art from consideration of the specification and practice of the invention disclosed herein.

In comparison to existing designs, the present apparatus and method holds the waste bag in the open position, in which the opening is substantially circular. This circular opening represents a significant improvement over a square or rectangular opening, both in the efficiency of filling the bag and in the ease of inserting and removing the device once the bag is filled. The present device also does not include sharp corners as many conventional devices that can tear the bag. Unlike the funnel-type devices, the disclosed device does not incorporate a bottleneck created by a narrowed opening into the waste bag. Furthermore, the present device can be used with virtually any size waste bag and any bag material, and the simplicity of its design makes the device very resilient for a long life.

Example 1

The embodiment illustrated in FIG. 4 provides an example of suitable dimensions for the two-section apparatus in an embodiment and an exemplary connection means. In this example, 160 and 175 are the lengths of the top and bottom sections, respectively, and 165 and 180 are the heights or depths of the top and bottom sections, respectively. Dimensions 190 and 195 illustrate exemplary dimensions of cut-outs 185, and angles can be calculated accordingly. While it is not necessary that 160 and 175 are the same, or 165 and 180 are the same, it has been found that these are useful embodiments.

In this example, 160 and 175 are about 68 inches, but have been found to usefully vary from about 63 inches to about 73 inches. In this example, 165 and 180 are about 22 inches each, but have been found to be usefully varied from about 17 to about 27 inches. Also in this example, 190 can be about 16 inches and 195 can be about 8 inches. Each of 190 and 195 can also vary if desired, for example, by about ±3 inches, consistent with the dimensions of 175 and 180. Also in this example, a strip of fabric 205 can be connected to both top section 155 and bottom section 170 (shown connected only to the top section in FIG. 4) to allow the top and bottom sections to readily fold so that the apparatus can be stored and deployed easily. The Example 1 and FIG. 4 illustration uses rivets 210 such as snap rivets as an exemplary means for connecting the fabric strip 205 to both top and bottom sections. The rivets 210 extend through holes 215 in both top and bottom sections, although holes 215 are shown only in the bottom section because the rivets are shown connecting the fabric strip 205 to the top section in FIG. 4.

Alternatively, adhesive tape of some type, such as a heavy duty plastic or fabric adhesive tape is used to permanently or semi-permanently connect top and bottom portions, such that they can be easily unfolded for use, and refolded or collapsed for storage without removing and reattaching the adhesive tape or fabric.

These dimensions as applied to FIG. 4 are exemplary only for the apparatus, and these exemplary lengths, angles, and cut-outs can be similarly used to describe the single-piece construction in which the top section and the bottom section are cut from a single piece of material.

Unless otherwise indicated, the following definitions are applicable to this disclosure. To the extent that any definition or usage provided by any document incorporated by reference conflicts with the definition or usage provided herein, the definition or usage provided herein controls. In this specification and in the claims that follow, reference will be made to a number of terms, which shall be defined to have the following meanings "Optional" or "optionally" means that the subsequently described event or circumstance can or cannot occur, and that the description includes instances where the event or circumstance occurs and instances where it does not.

By the terms "essentially" or "substantially", or other forms of the word such as "substantial", it is meant a deviation from the stated value of less than 10%, less than 5%, or less than 2%.

The term "collapsed" configuration is used interchangeably herein with the corresponding terms "planar" or "flat" configuration. Similarly, the term "expanded" configuration is used interchangeably herein with the corresponding term "cylindrical" configuration. The terms "cylinder", "cylindrical" and the like are intended to reflect a general idealized structure that is cylinder-like, and is not required that the portion of the apparatus described as cylindrical actually have the top portion trace out or encompass the entirety of the cylinder, but rather only a portion thereof.

When values are expressed as approximations, by use of the antecedent "about," it will be understood that the particular recited value forms another embodiment. It is also understood that when a particular value is disclosed, "about" that particular value in addition to the value itself. For example, if the value "10" is disclosed, then "about 10" is also disclosed.

Unless indicated otherwise, when a range of any type is disclosed or claimed, for example a range of angles or lengths, it is intended that the stated range disclose or claim individually each possible number that such a range could reasonably encompass, including any sub-ranges and combinations of sub-ranges encompassed therein. For example, when describing a range of measurements such as angles, every possible number that such a range could reasonably encompass can, for example, refer to values within the range with one significant digit more than is present in the end points of a range. In this example, an angle of between 80° and 90° includes, individually, 80°, 81°, 82°, 83°, 84°, 85°, 86°, 87°, 88°, 89°, and 90°. Applicant's intent is that these two methods of describing the range are interchangeable. Moreover, when a range of values is disclosed or claimed, which Applicants intend to reflect individually each possible number that such a range could reasonably encompass, Applicants also intend for the disclosure of a range to reflect, and be interchangeable with, disclosing any and all sub-ranges and combinations of sub-ranges encompassed therein. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

What is claimed is:

1. An apparatus for use with a waste bag, the apparatus having a collapsed configuration and an expanded configuration and comprising in its collapsed configuration:

a) a first flexible sheet comprising a front side and a back side, and when viewed from the front side, a left edge, a right edge, a top edge, and a bottom edge having a left portion, a center portion, and a right portion;

b) a second flexible sheet comprising a front side and a back side, and when viewed from the front side, a left edge, a right edge, a top edge having a left portion, a center portion, and a right portion, and a bottom edge;

the second flexible sheet further comprising a first cut-out defined by portions of the top edge and the left edge, and a second cut-out defined by portions of the top edge and the right edge; and c) means for connecting the center portion only of the bottom edge of the first flexible sheet to the center portion only of the top edge of the second flexible sheet that allows the first and second flexible sheets to be folded or reversibly attached;

wherein the first flexible sheet is flexibly biased toward the collapsed configuration.

2. An apparatus according to claim 1, wherein the first and second cut-outs are triangular.

3. An apparatus according to claim 1, wherein the means for connecting is selected from adhesive tape, adhesive fabric, hook-and-loop fasteners, interlock tabs and slots, corresponding hooks and holes, corresponding hooks and loops, adhesive fabric and rivets, tear-resistant fabric and rivets.

4. An apparatus according to claim 1, wherein the first flexible sheet and the second flexible sheet comprise a thermoplastic or a thermoplastic elastomer.

5. An apparatus according to claim 1, wherein the first flexible sheet and the second flexible sheet are selected from a polyolefin, a polyester, a polyamide, a polyimide, a polylactide, copolymers thereof, and blends thereof.

6. An apparatus according to claim 1, wherein the first flexible sheet and the second flexible sheet are selected from polyethylene, polypropylene, polyethylene terephthalate, polyethylene isophthalate, a copolymer thereof, and a blend thereof.

7. An apparatus according to claim 1, wherein the first flexible sheet further comprises at least one silicone dot on the back side.

8. An apparatus according to claim 1, wherein the first flexible sheet further comprises at least one first fastener piece on the back side of the left or right edge, and at least one corresponding second fastener piece on the front side of the right or left edge, respectively.

9. An apparatus according to claim 8, wherein the first and second fastener pieces are selected from: a) corresponding portions of hook-and-loop pieces; b) a snap fastener; and c) hooks and holes.

10. An apparatus according to claim 1, further comprising one or more holes along the bottom edge of the second flexible sheet.

11. An apparatus according to claim 1, wherein the apparatus in its expanded configuration is characterized by:

connecting the first and second flexible sheets by the means for connecting; and folding the left edge and the right edge of the first flexible sheet toward each other to substantially form the first flexible sheet into a cylinder or a portion of a cylinder, while the second flexible sheet remains substantially planar.

12. An apparatus according to claim 11, wherein the apparatus in its expanded configuration is further characterized by:

the first flexible sheet further comprising at least one first fastener piece on the back side of the left or right edge, and at least one corresponding second fastener piece on the front side of the right or left edge, respectively; and at least one of the first fastener pieces and at least one of the second fastener pieces being fastened to each other, to hold the left and right edges of the first flexible sheet in close proximity.

13. An apparatus for use with a waste bag, the apparatus having a collapsed configuration and an expanded configuration and comprising in its collapsed configuration:

a) a first flexible sheet comprising a front side and a back side, and when viewed from the front side, a left edge, a right edge, a top edge, and a bottom edge having a left portion, a center portion, and a right portion;

b) a second flexible sheet comprising a front side and a back side, and when viewed from the front side, a left edge, a right edge, a top edge having a left portion, a center portion, and a right portion, and a bottom edge having a length extending from the left edge to the right edge;

wherein the first flexible sheet and the second flexible sheet each has a length, extending from their respective left to right edges and measured along either of their respective top or bottom edges, and each has a height, extending from their respective top to bottom edges and measured along either of their respective left or right edges; and c) means for connecting the center portion only of the bottom edge of the first flexible sheet to the center portion only of the top edge of the second flexible sheet that allows the first and second flexible sheets to be folded or reversibly attached; wherein the lengths of the first and second flexible sheets are substantially the same, and the heights of the first and second flexible sheets are substantially the same; and the first flexible sheet is flexibly biased toward the collapsed configuration.

14. An apparatus according to claim 13, wherein the means for connecting is selected from adhesive tape, adhesive fabric, hook-and-loop fasteners, interlock tabs and slots, corresponding hooks and holes, corresponding hooks and loops, adhesive fabric and rivets, tear-resistant fabric and rivets.

15. An apparatus according to claim 13, wherein the first flexible sheet and the second flexible sheet comprise a thermoplastic or a thermoplastic elastomer.

16. An apparatus according to claim 13, wherein the first flexible sheet and the second flexible sheet are selected from polyethylene, polypropylene, polyethylene terephthalate, polyethylene isophthalate, a copolymer thereof, and a blend thereof.

17. An apparatus according to claim 13, wherein the first flexible sheet further comprises at least one silicone dot on the back side.

18. An apparatus according to claim 13, wherein the first flexible sheet further comprises at least one first fastener piece on the back side of the left or right edge, and at least one corresponding second fastener piece on the front side of the right or left edge, respectively.

19. An apparatus according to claim 13, further comprising one or more holes along the bottom edge of the second flexible sheet.

20. An apparatus according to claim 13, wherein the apparatus in its expanded configuration is characterized by:

connecting the first and second flexible sheets by the means for connecting; and folding the left edge and the right edge of the first flexible sheet toward each other to substantially form the first flexible sheet into a cylinder or a portion of a cylinder, while the second flexible sheet remains substantially planar.

21. An apparatus according to claim 20, wherein the apparatus in its expanded configuration is characterized by:

the first flexible sheet further comprising at least one first fastener piece on the back side of the left or right edge, and at least one corresponding second fastener piece on the front side of the right or left edge, respectively; and at least one of the first fastener pieces and at least one of the second fastener pieces being fastened to each other, to hold the left and right edges of the first flexible sheet in close proximity.

* * * * *